United States Patent [19]

Tuzson

[11] 4,246,878

[45] Jan. 27, 1981

[54] FLUID JET CARBURETOR

[75] Inventor: John J. Tuzson, Evanston, Ill.

[73] Assignee: Borg-Warner Corporation, Chicago, Ill.

[21] Appl. No.: 27,640

[22] Filed: Apr. 6, 1979

[51] Int. Cl.[3] ..... F02M 7/12; F02M 17/18

[52] U.S. Cl. ..... 123/523; 261/36 A

[58] Field of Search ..... 261/36 A, DIG. 39, 78 R; 123/133, 128, 139 AW

[56] References Cited

U.S. PATENT DOCUMENTS

| | | | |
|---|---|---|---|
| 2,024,419 | 12/1935 | Ball | 261/36 A |
| 2,454,974 | 11/1948 | Mennesson | 261/36 A |
| 3,977,382 | 8/1976 | Tuzson | 261/36 A |
| 4,130,610 | 12/1978 | Paul | 261/36 A |
| 4,155,336 | 5/1979 | Hallberg | 261/36 A |

*Primary Examiner*—Ronald H. Lazarus

*Attorney, Agent, or Firm*—Aubrey L. Burgess

[57] ABSTRACT

A charge forming apparatus for metering fuel in which a stream of induction air impinges upon a stream of liquid fuel in which the fuel is stripped from the stream of liquid fuel for dispersing into the air stream and excess fuel is returned to the fuel source. The stream of liquid fuel is flat and wider than it is high.

1 Claim, 4 Drawing Figures

FLUID JET CARBURETOR

BACKGROUND OF THE INVENTION

In charge forming apparatus for metering fuel where a stream of induction air impinges upon a stream of liquid fuel for changing the shape thereof. Fuel is stripped from the reformed liquid stream for dispersion into the air stream. In such apparatus the use of a float is avoided. Fuel is fed from a source to a tubular member having a slot therein for exposing the stream to the air; excess fuel is collected and returned to the source. In the usual forms of this "fluid jet" carburetor system, the slot is such that the stream of liquid fuel is substantial round in section.

THE INVENTION

According to the invention herein described, the apparatus is constructed to provide a wider than high stream of fuel with a generally flat surface configuration to the impinging air stream instead of the usual round configuration providing a greater operating range of constant air/fuel ratio.

THE DRAWINGS

DETAILED DESCRIPTION

Figure 1:
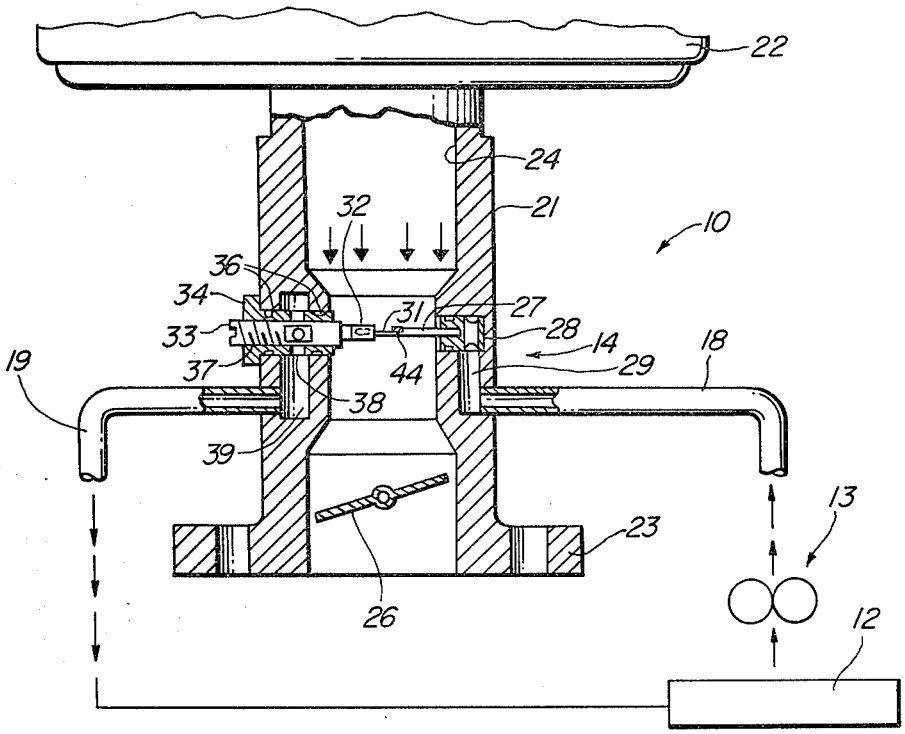
FIG. 1 is a longitudinal sectional view of a fuel system according to this invention.

The drawing illustrates a fuel system 10 according to this invention which comprises a fuel tank 12, a pump 13 and charge forming apparatus 14 together with connecting conduits 18 and 19 arranged for supplying and recirculating fuel from the tank 12 to the charge forming apparatus 14 and recirculating excess fuel from the apparatus 14 to the tank 12. The fuel tank 12, pump 13, and conduits 18 and 19 may be of conventional construction.

The charge forming apparatus 14 comprises a body 21 having an air cleaner 22 mounted at one end and having a mounting flange 23 for mounting the structure on the inlet manifold of an internal combustion engine. An air inlet passage 24 extends through the body 21. A rotatable throttle plate 26 is mounted in the air inlet passage 26 for controlling the air flow through the charge forming apparatus. A hollow tube or regulator 27 is mounted in a fitting 25 to receive fuel from a cavity 29 formed in the body 21. The cavity 29 is connected to the conduit 18 and the pump 13 which pumps fuel from the fuel tank 12 to the cavity 29. The tube or regulator 27 extends generally horizontally across the air passage 24 and includes an outlet port 31 facing upstream, so as to receive the impact of air flow in the air passage, the air stripping fuel from the port 31 to the intake manifold of the engine. A second tube 32 receives the tube 27 and is axially adjustably in a fitting 33 for marking a portion of the port 31. The fitting 33 is provided with threads 37 and apertures 38, the threads 37 providing means for adjusting the size of the port 31 while the apertures 38 provide for conducting excess fuel from the tube 27 to a cavity 39 formed in the body 21, the cavity 39 being connected to the fuel tank 12 by the conduit 19.

Figure 2:
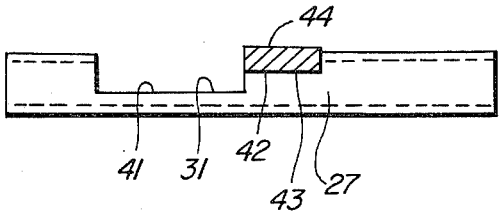
FIG. 2 is an enlarged view of a fuel delivery body according to this invention.

Attention is invited to FIG. 2 which is an enlarged view of the tube 27 with the port 31 therein according to this invention. The flow of fuel there through is indicated by appropriate arrows; the port 31 has defining side edges or walls 41 which extend generally axially of the tube 27. The walls 41 may be located above or below the axis of the tube 27. In addition, there is an opening 42 joining the port 31 positioned upstream of the port 31 with defining side walls 43 located horizontally above the walls 41. A member 44 is supported by the walls 43 and thus provides a means to insure a stream of fuel which is wider than high with a generally flat surface as it flows across the opening 31.

Figure 3:
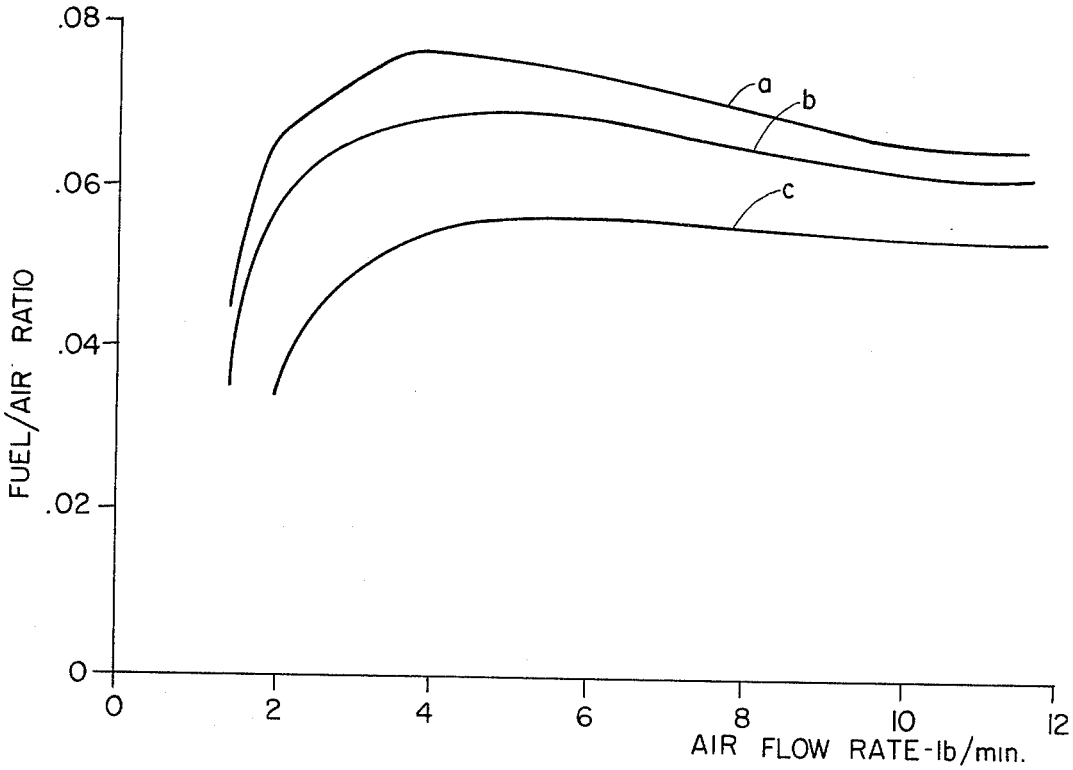
FIGS. 3 and 4 are curves for comparing the performance of a system according to this invention with a prior art system.
Figure 4:
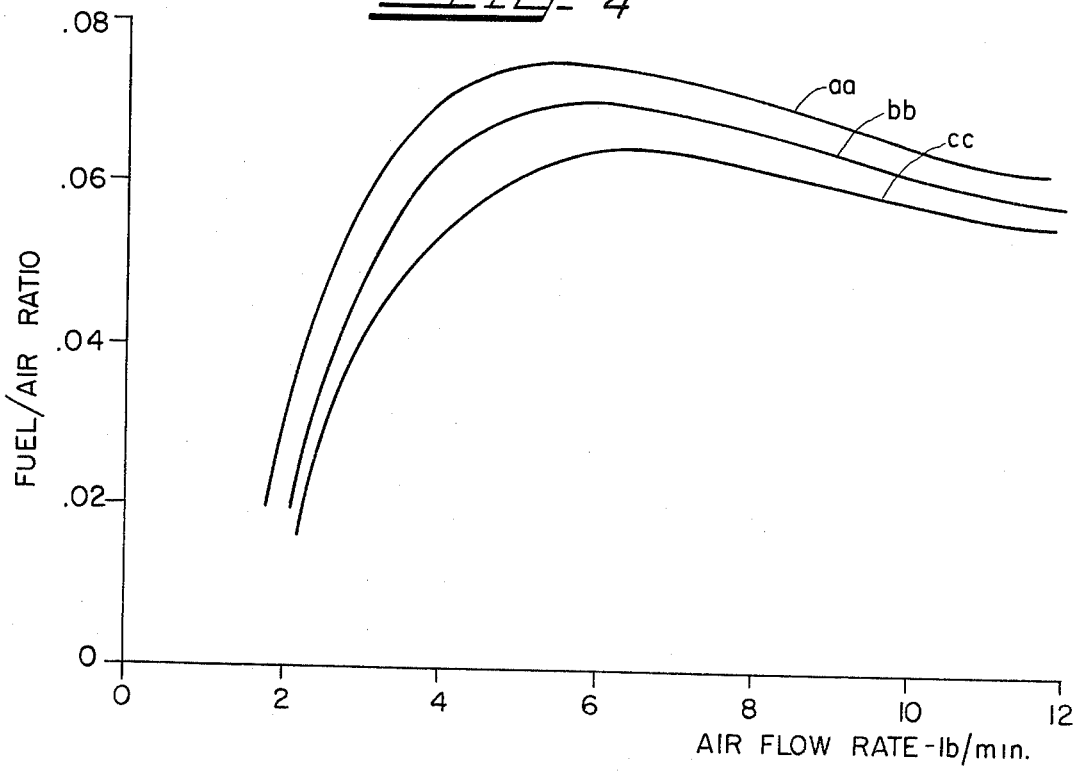

Attention is now invited to FIGS. 3 and 4 which are curves for fuel/air ratio plotted against air flow rate in pounds/minute. FIG. 3 is a set of curves for a fuel system with a delivery tube constructed according to this invention while FIG. 4 is a set of curves of a system with a delivery tube presenting a substantially round-top stream to the flowing air, generally no wider than high.

The tubes had the same diameters; i.e., 0.071 diameter, the fuel pressure was 3 psi and three axial dimensions for the outlet port were used so that corresponding curves represent like conditions except FIG. 3 provided a stream using the apparatus of this invention while FIG. 4 provided a round top stream as provided by the prior art apparatus. Comparison of the curves a,b,c, and aa, bb, cc, respectively, show that the apparatus constructed according to this invention provides a more uniform fuel/air ratio under various operating conditions.

I claim:

1. In a liquid fuel system for supplying fuel from a source to an internal combustion engine and the like having a liquid fuel source and a charge forming apparatus arranged for recirculating excess fuel, a regulator in said charge forming apparatus comprising a generally horizontally positioned tubular member with its bore connected at one end to said source of fuel and at the other end to a return for excess fuel, said tubular member having an elongated, upwardly oriented outlet port positioned to be exposed to a stream of air which strips fuel flowing as a stream of fuel across the outlet port, the improvement comprising:

a generally horizontal member positioned closely adjacent to said outlet port and restricting the bore of said tubular member to change the shape of the stream of fuel flowing across said outlet port to provide a relatively flat wide-stream of fuel across said outlet port.

* * * * *